US006286404B1

(12) United States Patent
Miglietta

(10) Patent No.: US 6,286,404 B1
(45) Date of Patent: Sep. 11, 2001

(54) CUTTING EQUIPMENT WITH AUTOMATIC POSITIONING APPARATUS

(75) Inventor: Adelio Miglietta, Villanova Monferrato (IT)

(73) Assignees: Maurizio Miglietta; Massimo Miglietta, both of (IT)

( * ) Notice: Subject to any disclaimer, the term of this patent is extended or adjusted under 35 U.S.C. 154(b) by 0 days.

(21) Appl. No.: 09/125,962

(22) PCT Filed: Feb. 24, 1997

(86) PCT No.: PCT/EP97/00958

§ 371 Date: Aug. 25, 1998

§ 102(e) Date: Aug. 25, 1998

(87) PCT Pub. No.: WO97/31760

PCT Pub. Date: Sep. 4, 1997

(30) Foreign Application Priority Data

Feb. 29, 1996 (IT) ..... TO96A0147

(51) Int. Cl.[7] ..... B24D 19/04

(52) U.S. Cl. ..... 83/498; 83/499; 83/508.1

(58) Field of Search ..... 83/482, 498, 499, 83/500–504, 699, 508.1–508.3, 509, 510

(56) References Cited

U.S. PATENT DOCUMENTS

| | | | | |
|---|---|---|---|---|
| 3,376,774 | * | 4/1968 | Collins | 83/482 |
| 3,491,632 | | 1/1970 | Dovey | 83/11 |
| 3,886,833 | | 6/1975 | Gunn et al. | 83/499 |
| 4,237,761 | | 12/1980 | Coburn | 83/665 |
| 4,676,133 | * | 6/1987 | Fujimura | 83/497 |
| 4,781,668 | | 11/1988 | Mowry | 493/365 |
| 4,859,085 | * | 8/1989 | Buessinger et al. | 384/45 |
| 5,025,693 | * | 6/1991 | Tidland | 83/482 |
| 5,170,688 | * | 12/1992 | Keech et al. | 83/499 |
| 5,325,753 | * | 7/1994 | Schusler et al. | 83/481 |

FOREIGN PATENT DOCUMENTS

| | | | |
|---|---|---|---|
| 4424197A1 | 1/1986 | (DE) | B26D/7/26 |
| 4224010A1 | 2/1993 | (DE) | B65H/7/20 |
| 29504644.9 | 7/1995 | (DE) | B26D/7/26 |
| 0 258 442 | 3/1988 | (EP) | B26D/1/24 |
| 0444612A1 | 9/1991 | (EP) | B26D/7/26 |
| WO96/28284 | 9/1996 | (WO) | B26D/7/26 |

OTHER PUBLICATIONS

PCT/EP97/00958 International Search Report.

* cited by examiner

*Primary Examiner*—Lee Young
*Assistant Examiner*—Sean Smith
(74) *Attorney, Agent, or Firm*—Myers Bigel Sibley & Sajovec, P.A.

(57) ABSTRACT

Equipment for cutting sheet material includes a plurality of pairs of blade units and counter-blade units slidable and fixable on respective support members, elongate in a direction perpendicular to that of the flow of the material being cut. The support members are common to a plurality of blade units or counter-blade units. The equipment further includes a unit for selectively engaging the blade and counterblade units with respective first and second carriages. The selective engagement units include a support structure on which is mounted a respective actuator including a piston, the distal end of which is shaped so as, in its extended position, to be able to engage a pin which projects from each blade unit and counter-blade unit respectively.

8 Claims, 2 Drawing Sheets

CUTTING EQUIPMENT WITH AUTOMATIC POSITIONING APPARATUS

The present invention relates to equipment for cutting sheet material, for example paper or plastics material, comprising a plurality of pairs of blade units and counter-blade units slidable and fixable on respective elongate support members.

Cutting equipment of the type indicated above is used, for example, in winding-cutting machines, that is machines which can unwind a roll of the sheet material, for example paper or plastics film, cut it into several sections perpendicular to its axis and rewind the cut sections to form rolls of shorter axial extent than that of the starting roll.

The object of the present invention is to provide automatic cutting equipment in which it is possible to adjust the axial extent of the various sections cut from the starting sheet material rapidly and in a desired manner.

This object is achieved by equipment of the type indicated above characterised in that it includes:

- a first positioning carriage which can move parallel to the elongate supporting member of the counter-blade units and which has means for selectively engaging the counter-blade units and means for locking the units selectively relative to the elongate support member,
- a second positioning carriage which can move parallel to the elongate support member of the blade units and which has means for selectively engaging the blade units and means for locking the units selectively relative to the elongate support member,
- drive means which can drive the first and second carriages to move uniformly and in synchronism with each other,
- means for detecting the axial position of at least one of the carriages, and
- a control unit for controlling the drive means, the selective engagement means and the selective locking means.

In the equipment of the invention, the positioning of the various blade and counter-blade units is achieved by the two carriages which, at any particular time, locate them at the desired positions along the respective elongate support members by means of a series of operations of unlocking, longitudinal movement and locking. These operations are controlled by the control unit which has previously been programmed appropriately and which continuously receives signals output by the detector means in order to effect any adjustments necessary to ensure that the actual positions of the blade and counter-blade units conform with the desired positioning.

Thus, once the various blade and counter-blade units have been positioned and the cutting operation is started, it is possible for the starting sheet material to be cut into strips of the desired widths.

The equipment of the invention also has the advantage that it does not require the removal of the roll of sheet material, which must subsequently be cut, from the associated winding-cutting machine during the period in which the positions of the blades and counter-blades are adjusted.

Further advantages and characteristics of the present invention will become apparent from the detailed description which follows, given with reference to the appended drawings, provided purely by way of non-limitative example, in which.

Figure 1:
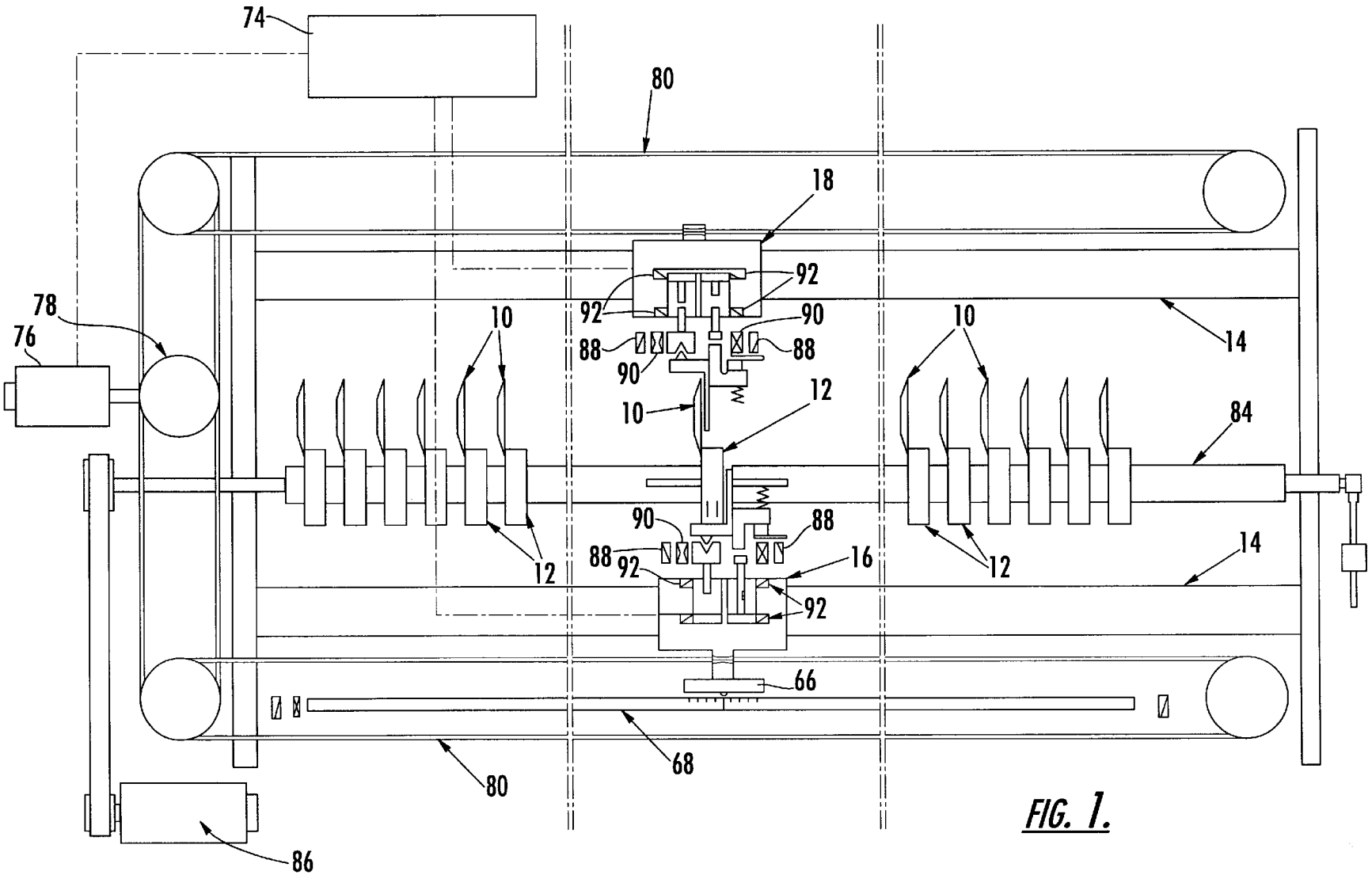
FIG. 1 is a schematic view of cutting equipment according to the invention.

Equipment for cutting sheet material, for example of paper or plastics material, comprises (FIG. 1) a plurality of pairs comprising a blade unit 10 and a counter-blade unit 12 slidable and fixable on respective elongate support members 14 and a first positioning carriage 16 and a second positioning carriage 18 for positioning the counter-blade units 12 and the blade units 10 respectively. For reasons of clarity, in FIG. 1, the units 10 and 12 are illustrated spaced from their respective elongate support members 14.

Figure 2:
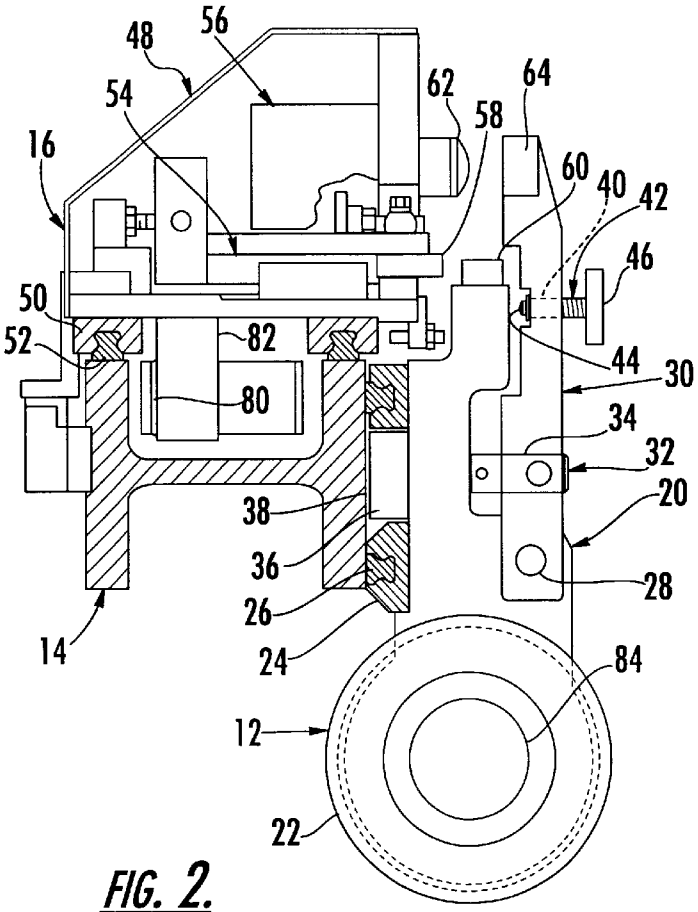
FIG. 2 is a front elevational view illustrating the first carriage and a counter-blade unit of the equipment of FIG. 1.

Each counter-blade unit 12 includes (FIG. 2) a support frame 20 and a counter-blade proper 22. Each frame has splined shoes 24 for facilitating its sliding along raised ribs 26 fixed to the respective elongate support member 14. Each frame 20 also carries a respective lever 30 pivoted at one end 28 thereon and from which projects transversely a brake element 32 which can bear against the elongate support member 14.

The brake element 32 comprises a shaft 34 fixed at one end to the lever 30 and having a head 36 at its opposite end which has a surface 38 which can come into frictional contact with the elongate support member 14.

The lever 30 also has a threaded through-hole 40 which can receive a screw 42, the distal end 44 whereof, opposite the actuating head 46, can bear against the frame 20.

The first positioning carriage 16 includes a support structure 48 which has splined shoes 50 which enable it to slide along raised ribs 52 fixed to the respective elongate support member 14, a first actuator 54 and a second actuator 56, preferably of pneumatic type, being mounted on the first carriage.

The first actuator 54 includes a piston, the distal end 58 whereof has a shape—for example semicircular and concave in plan view—such as to enable it, in its extended position, to engage a pin 60 projecting from the frame 20 of a counter-blade unit 12. As will become clear from the description of operation below, it is thus possible to engage the carriage 16 selectively with the counter-blade unit 12.

The second actuator 56 includes a piston, the distal end 62 whereof, in its extended position, is arranged to contact the end 64 of the lever 30 opposite the pivoted end 28 so as to cause the unit 12 to be unlocked from the elongate support member 14, as will be described fully below.

The first carriage 16 also carries (FIG. 1) a position detector sensor 66 adapted to cooperate with a magnetic ruler 68 parallel to the elongate support members 14.

Figure 3:
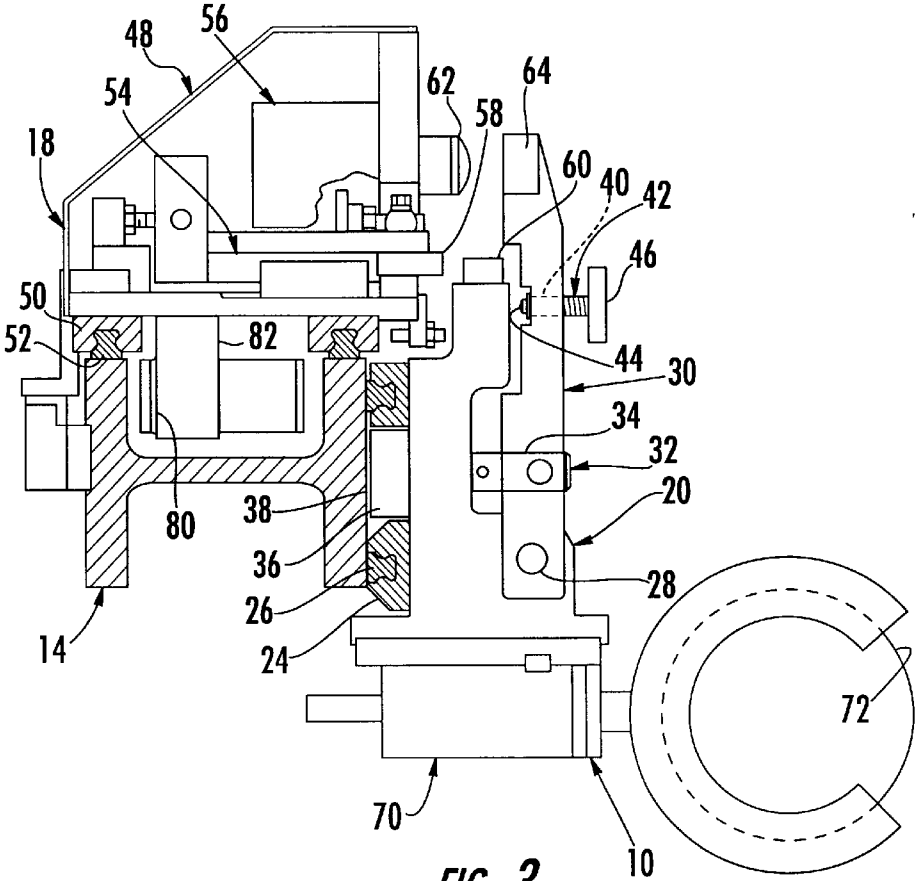
FIG. 3 is a front elevational view illustrating the second carriage and a blade unit of the equipment of FIG. 1.

The structure of the second carriage 18 and of the blade units 10, illustrated in FIG. 3, is substantially the same as that of the first carriage 16 and of the counter-blade units 12. The same reference numbers have therefore been assigned to parts equivalent to or the same as those described previously.

As may be noted, each blade unit 10 also includes a spacer member 70 which enables the blade 72 to project from the frame 20.

The equipment further includes (FIG. 1) a central control unit 74 and drive means for the carriages 16, 18 comprising an electric motor 76 connected to a transmission mechanism 78 with one input and two outputs, from which extend two belts 80, each of which can engage (FIGS. 2 and 3) an appendage 82 projecting from the support structure 48 either of the first carriage 16 or of the second carriage 18 respectively.

The equipment further includes (FIG. 1) a radially expansible shaft 84 which can be rotated by a respective motor 86 and around which are mounted (FIG. 2) all of the counter-blades 22 of the various counter-blade units 12.

The control system for the equipment is finally completed by proximity switches, means for detecting the centring of the carriages 16, 18 and sensors for sensing the positions of the pistons of the actuators 54, 56. These components are in themselves known and shown schematically at 88, 90 and 92 in FIG. 1.

In use of the cutting equipment, the various pairs of blade units 10 and counter-blade units 12 are longitudinally spaced along their respective elongate support members 14 so as to allow a continuous web of sheet material to be cut into a plurality of strips each having a width corresponding to the spacing between the respective adjacent pairs of blade units 10 and counter-blade units 12.

Before the cutting operation, in order to achieve the desired positioning of the various units 10, 12, the control unit 74 is first programmed with data relative to this positioning.

Then the control unit 74 activates the motor 76 and, through the transmission mechanism 78 and the belts 80, causes the two carriages 16, 18 to move uniformly and in synchronism into positions adjacent a blade unit 10 and a counter-blade unit 12 respectively constituting a first pair, which are initially in a parked position.

Once they have reached this position, the pistons of the second actuators 56 of the two carriages 16, 18 are extended so as to pivot the levers 30 about their pivoted ends 28 and disengage the friction surfaces 38 of the heads 36 of the brake elements 32 from the respective elongate support members 14 so that the units 10, 12 are thus released from engagement therewith and are free to slide.

The pistons of the first actuators 54 are then extended so that their distal ends 58 engage the respective pins 60 of the units 10, 12 which are thus made fast with the respective carriages 16, 18.

The subsequent actuation of the motor 76 then causes the translational movement of the carriages 16, 18, together with the units 10, 12 fixed thereto, and these latter are thus driven to their desired positions. Once these positions have been reached, the pistons of the first actuators 54 are retracted, releasing the units 10, 12 from the carriages 16, 18. The pistons of the second actuators 56 are also retracted, causing the anticlockwise pivoting of the levers 30 which are urged in this sense by springs not illustrated in the drawings. Thus the friction surfaces 38 of the heads 36 of the brake elements 32 are returned to the positions illustrated in FIGS. 2 and 3 in which they contact their respective elongate support members 14 and lock the respective units 10, 12 so as to prevent further sliding.

The cycle of operations just described is then repeated in a similar manner for all the other pairs comprising a blade unit 10 and a counter-blade unit 12 until all of them are located in their respective desired positions.

During each cycle, the sensor 66 continuously transmits to the control unit 74 information relative to the position of the first carriage 16, with which a very precise position of the second carriage 18 is univocally associated by virtue of the coupling determined by the transmission mechanism 78. Hence, whenever a difference is found between the actual positions and the desired positions, the control unit 74 may cause suitable adjustments to be made to cancel these differences.

Finally once all of the units 10, 12 have been moved to their desired positions, the shaft 84 is expanded radially so as to fix the counter-blades 22 securely to it.

The equipment is thus ready for the cutting proper which is carried out in a manner similar to that of conventional equipment.

It is clear from the description above that the positioning of the various units 10, 12 takes place very quickly and precisely, being completely automated and controlled continuously. The time for which the machine must be stopped in order for the cutting equipment to be moved from one configuration to another is thus considerably reduced, with obvious economic benefit.

At the same time, in order to ensure that the equipment is even more reliable, the option of manual positioning of the various units 10, 12 is provided so as to avoid emergencies such as a failure of the electrical power supply and the like.

In manual positioning, the screw 42 of a given unit is first screwed into its hole 40 so that its distal end 44 bears against the facing surface of the frame 20 and causes the lever 30 to pivot in a manner similar to that caused by the distal end 62 of the piston of the second actuator 56 during automatic positioning. Thus the brake element 32 is disengaged from the respective elongate support member 14 and the unit 10, 12 may be slid manually to the desired position. At this point, the screw 42 is again unscrewed so that the lever 30 is returned, by pivoting in the opposite sense from its previous pivoting, to its starting position in which the head 36 of its brake element 32 is in frictional contact with the respective elongate support member 14, locking the unit 10, 12 in the desired position.

Naturally, the principle of the invention remaining the same, the constructional details and forms of embodiment may be varied widely with respect to that described and illustrated, purely by way of example, without thereby departing from its scope.

What is claimed is:

1. Equipment for cutting sheet material for example plastics, comprising: a plurality of pair of blade units (10) and counter-blade units (12) slidable and fixable on respective support members (14), elongate in a direction perpendicular to that of the flow of the material being cut, the support members (14) being common to a plurality of blade units (10) or counter-blade units (12), the equipment including:

a first carriage (16) for positioning and moving the counter-blade units (12), which can move parallel to the elongate support member (14) of the counter-blade units (12) and which has means for selectively engaging each of the counter-blade units (12) and means for locking each of the units (12) individually and selectively relative to the elongate support member (14), a second carriage (18) for positioning and moving the blade units (10), which can move parallel to the elongate support member (14) of the blade units (10) and which has means for selectively engaging each of the blade units (10) and means for locking each of the units (10) individually and selectively relative to the elongate support member (14), drive means which can drive the first (16) and second (18) carriages to move uniformly and in synchronism with each other, means for detecting the axial position along the respective support member (14) of at least one of the carriages (16, 18), and a control unit (74) for controlling the drive means, the selective engagement means and the selective locking means, said equipment being characterized in that the means for selectively engaging the counter-blade and the blade units (12, 10) of respectively the first and second carriages (16, 18) comprises a support structure (48) on which is mounted a respective actuator (54) including a piston, the distal end (58) of which is shaped so as, in its extended position, to be able to engage a pin (60) which projects from each blade unit (10) and counter-blade unit (12) respectively.

2. Cutting equipment according to claim 1, characterized in that a respective lever (30) is pivotally attached by one end (28) to the frame (20) of each blade unit (10) and counter-blade unit (12) and carries a brake element (32) which projects transversely therefrom and is arranged to bear against the respective elongated support member (14), and in that a respective second actuator (56) is mounted on the support structure (48) of each of the first (16) and second (18) carriages and includes a piston, the distal end (62) whereof, when extended, is arranged to about the end (64) of the lever (30) opposite the pivoted end (28).

3. Cutting equipment according to claim 2, characterized in that the lever (30) is formed with a threaded through-hole (40) into which can be screwed a screw (42), the distal end whereof opposite the actuating head (46) can be brought to bear against the frame (20) of the unit (10,12), so as to take away the brake element (32) from the respective support member (14).

4. Cutting equipment according to claim 2, characterized in that the brake element (32) comprises a shaft (34) fixed at one end to the lever (30) and, at its opposite end, carrying a head (36) with a surface (38) intended to come into frictional contact with the respective elongate support member (14).

5. Cutting equipment according to claim 3 or 4, characterized in that the drive means comprise an electric motor (76) connected to a transmission mechanism (78) with one input and two outputs from which extend two belts (80) each of which can engage a respective appendage (82) which projects from the support structure (48) of the first carriage (16) or the second carriage (18).

6. Cutting equipment according to claim 5, characterized in that the detector means comprise a position sensor (66) mounted on the first positioning carriage (16) and adapted to cooperate with a magnetic rule (68) mounted parallel to the elongate support members (14).

7. Cutting equipment according to claim 5, characterized in that the first carriage (16) and the second carriage (18) can slide along the same elongate support members (14) as those on which the counter-blade units (12) and the blade units (10) slide, the frames (20) of the blade units (10) and counter-blade units (12) and the support structures (48) of the first carriage (16) and the second carriage (18) being provided with splined shoes (24, 50) for enabling them to slide on respective raised ribs (26, 52) fixed to the elongate support members (14).

8. Cutting equipment according to claim 5, characterized in that it includes a radially expansible shaft (84) which can be rotated by a respective motor (86) and around which are mounted all the counter-blades (22) of the various counter-blade units (12).

* * * * *